US009802136B2

(12) United States Patent
Zahornacky et al.

(10) Patent No.: US 9,802,136 B2
(45) Date of Patent: Oct. 31, 2017

(54) SYSTEM AND METHOD FOR CONTROLLING LABOR IN A MODEL VEHICLE

(71) Applicant: Lionel L.L.C., Chesterfield, MI (US)

(72) Inventors: Jon F. Zahornacky, Santa Clara, CA (US); Timothy Dellas Lee, San Jose, CA (US)

(73) Assignee: Lionel LLC, Concord, NC (US)

( * ) Notice: Subject to any disclaimer, the term of this patent is extended or adjusted under 35 U.S.C. 154(b) by 758 days.

(21) Appl. No.: 13/645,316

(22) Filed: Oct. 4, 2012

(65) Prior Publication Data

US 2014/0100757 A1 Apr. 10, 2014

(51) Int. Cl.
*A63H 19/24* (2006.01)

(52) U.S. Cl.
CPC ..... *A63H 19/24* (2013.01)

(58) Field of Classification Search
CPC ..... G07C 5/008; G07C 5/0808; G07C 5/00; A63H 30/04; A63H 19/24
See application file for complete search history.

(56) References Cited

U.S. PATENT DOCUMENTS 6,457,681 B1 * 10/2002 Wolf ..... A63H 19/14 104/296
8,013,550 B1 * 9/2011 Young ..... A63H 19/24 246/187 A
8,030,871 B1 * 10/2011 Young ..... A63H 19/24 246/187 R

* cited by examiner

*Primary Examiner* — James Yang
(74) *Attorney, Agent, or Firm* — Fitzsimmons IP Law

(57) ABSTRACT

A system and method is provided for using load data to control a feature in a model vehicle. In one embodiment of the present invention, a model vehicle includes a controller in communication with a remote control, a motor module, a smoke module, a sound module, and a memory device. While the model vehicle is operated under test conditions, calibration data is collected and stored in the memory device. While the model vehicle is operated under normal conditions, the controller receives a speed step instruction from the remote control and instructs the motor module to operate the motor at a corresponding speed. The data used to propel the model vehicle at the corresponding speed it then provided to the controller, where it is compared to the calibration data to identify a delta therebetween. The delta is then used by the controller to control, for example, the smoke and sound modules.

20 Claims, 3 Drawing Sheets

SYSTEM AND METHOD FOR CONTROLLING LABOR IN A MODEL VEHICLE

BACKGROUND OF THE INVENTION

1. Field of the Invention

The present invention relates to generating at least one feature in a model vehicle or, more particularly, to a system and method for using data related to a load of the model vehicle to generate a corresponding sound and amount of smoke, or the like.

2. Description of Related Art

Model train engines having sound and smoke generating devices are well known in the art. Generally, these devices are controlled by a user via a remote control. For example, a user may instruct a model train to puff smoke (or steam) from a stack on the model train and play a corresponding "chuffing" sound. While doing so may begin to emulate what one would expect from an actual train, the mere activation of sound and smoke does not take into account different amounts of smoke and different sounds that one would expect from a laboring train (e.g., a train going up a hill, pulling a plurality of cars, etc.).

In an effort to address this drawback, some model trains are configured to vary sound and smoke in response to variations in speed of the model train. However, a speed of a model train may not necessarily equate to a particular load of a motor. For example, a vehicle traveling uphill at 10 MPH (e.g., at 3500 RPMs) would experience a larger load, and therefore output more smoke and a more labored sound, than a vehicle traveling downhill at 30 MPH (e.g., at 1000 RPMs).

Thus, it would be advantageous to design a more accurate system and method of calculating or estimating a load of a model vehicle, and using the calculated or estimated load to generate a corresponding sound and output a corresponding amount of smoke or steam.

SUMMARY OF THE INVENTION

The present invention provides a system and method for using motor load data to generate at least one feature in a model vehicle. Preferred embodiments of the present invention operate in accordance with a model train, a model train track, and a remote control.

In one embodiment of the present invention, a model train is configured to operate on a model train track, and a remote control is used to control various features of the model train. For example, a user may interact with the remote control to instruct the model train to move in a particular direction, to move at a particular speed, to produce smoke or steam, or to make a particular sound.

In this embodiment, the model train may include a plurality of components for carrying out instructions received from the remote control. For example, the model train may include a controller in communication with the remote control, a motor module, a smoke module, a sound module, and a memory device. By way of example, if the controller receives an instruction from the remote control to produce a particular sound, the controller may instruct the sound module to play the particular sound. Further, if the controller receives an instruction from the remote control to produce smoke or steam, the controller may activate the smoke module and instruct the sound module to play a corresponding sound. Finally, if the controller receives an instruction to vary speed, the controller may instruct the motor module to drive a motor accordingly. This may be done, for example, by varying voltage, varying current, or controlling a pulse width modulator (PWM).

In one embodiment of the present invention, the memory device is preferably a non-volatile memory (NVM) device that is configured to store calibration data for the model train. The calibration data is preferably collected while a model train is operating under test conditions, and includes at least one relationship between at least one speed and data used (under test conditions) to propel the model train at the at least one speed. For example, the calibration data may include relationships between different speed steps and different outputs from a PWM (i.e., PWM data). The PWM data can either be measured or extrapolated from measured data.

In another embodiment of the present invention, the controller is configured to receive a speed step instruction from a remote control and to instruct the motor module to operate the motor at a particular speed (i.e., a speed corresponding to the speed step instruction). This can be done, for example, by controlling the PWM. Given that the model train may be under a given load, the PWM must be sufficiently controlled to propel the model train at the particular speed. The resulting PWM data is then communicated to the controller, and used to calculate a load that the model train is under. This can be done, for example, by comparing the received PWM data to calibration data stored in the NVM, and determining a delta between the received and stored PWM data. For example, if the received PWM data for a speed step of X is M, and the calibration data provides that PWM data (under test conditions) for a speed step of X is Y, then the PWM delta is M−Y. The delta indicates (or estimates) the load in which the motor is operating under, and can be used by the controller to generate a corresponding sound and amount of smoke. In other words, the controller use the delta to control the smoke module (e.g., to produce a particular amount of smoke, to vary the interval of smoke, etc.) and the sound module (e.g., to produce a particular sound, to vary the volume of sound, etc.).

In another embodiment of the present invention, a method of collecting and recording calibration data is provided. The method involves operating a model vehicle under test conditions. While operating under test conditions, various components (e.g., controller, motor module, motor, memory, etc.) are used to collect data on propelling the model vehicle at particular speeds, or particular speed steps. The collected data can then be compiled and stored in a memory device, which can then be used during normal operating conditions to control at least one feature in the same or a different model vehicle.

In another embodiment of the present invention, a method of using previously stored calibration data to control at least one feature in a model vehicle is provided. The method involves storing calibration data in a memory device inside the model vehicle. While the model vehicle is being operated under normal conditions, data relating to a load of a motor in the model vehicle is collected. This data may include, for example, PWM data, voltage data or current data. The collected data is then compared to the calibration data stored in the memory device, and a delta is determined. For example, collected PWM data for a speed step can be compared to stored PWM data for that speed step in order to identify a particular delta. The delta can then be used to control at least one feature of the model vehicle.

A more complete understanding of a system and method for using data related to a load of a motor in the model vehicle to generate at least one feature will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for using data relating to a load of a motor in a model vehicle to generate at least one feature in the model vehicle. In the detailed description that follows, like element numerals are used to describe like elements illustrated in one or more figures.

Figure 1:
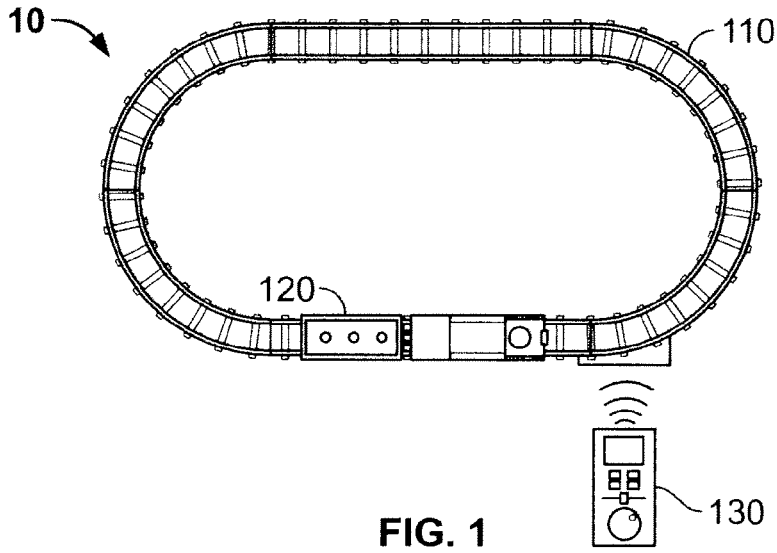
FIG. 1 illustrates a model train system in accordance with one embodiment of the present invention.

In one embodiment of the present invention, as shown in FIG. 1, the model vehicle is a model train 120 operating on a model train track 110. A remote control 130 may be used to control various features of the model train 120. For example, a user may interact with the remote control 130 to instruct the model train 120 (e.g., via a receiver in communication with the model train track and/or model train) to move in a particular direction, to move at a particular speed, to produce smoke or steam, or to make a particular sound.

It should be appreciated that the present invention is not limited to any particular type of model vehicle, and all model vehicles (e.g., cars, boats, planes, etc.) are within the spirit and scope of the present invention. It should also be appreciated that the present invention is not limited to any particular type of remote control, and includes all types of wired and wireless remote controls that are generally known to those of ordinary skill in the art. By way of example, remote controls can vary in how they are used to control speed. Some remote controls include at least one user interface (e.g., button, lever or dial) for increasing or decreasing the vehicle's speed. Others include at least one user interface for selecting a new vehicle speed. And yet others include at least one user interface for selecting a new step, wherein each step corresponds to a particular speed. It should be appreciated that while the present application refers to the term "speed step," that feature is used herein in its broad sense to encompass any interaction with a remote control that varies the speed of a model vehicle, regardless of whether the interaction is with a button, lever, dial, or the like, and regardless of whether the user is entering a particular speed or selecting a particular step that, in turn, corresponds to a particular speed.

Figure 2:
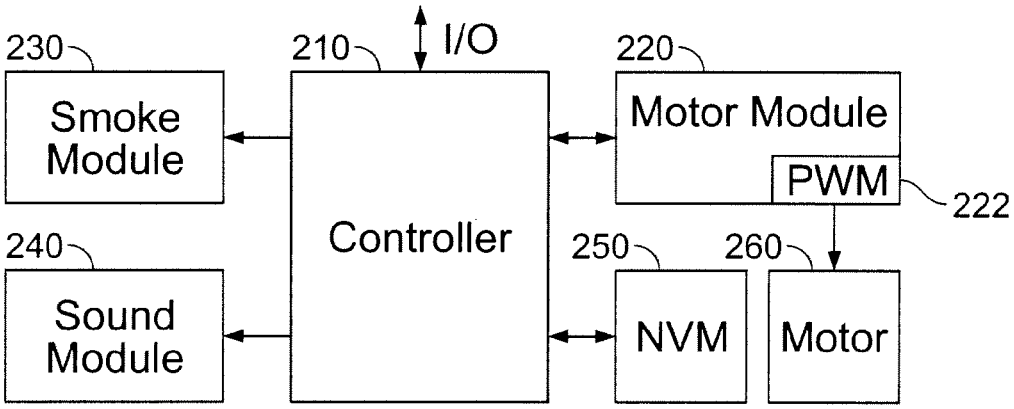
FIG. 2 illustrates components of a model train in accordance with one embodiment of the present invention.

In one embodiment of the present invention, the model train (e.g., engine, car, etc.) includes a plurality of components for, in part, carrying out instructions received from the remote control. For example, as shown in FIG. 2, the model train may include a controller 210 in communication with the remote control (e.g., via an I/O), a motor module 220, a smoke module 230, a sound module 240, and a memory device 250. For example, if the controller 210 receives an instruction from the remote control to produce a particular sound, the controller may instruct the sound module 240 to play the particular sound (e.g., as stored in memory, etc.). Further, if the controller 210 receives an instruction from the remote control to produce smoke or steam, the controller 210 may activate the smoke module 230 and instruct the sound module 240 to play a corresponding sound (e.g., a "chuffing" sound). Finally, if the controller 210 receives an instruction to vary speed, the controller 210 may instruct the motor module 220 to drive a motor 260 accordingly. This may be done, for example, by varying voltage, varying current, or operating a pulse width modulator (PWM) 222.

It should be appreciated that the present invention is not limited to vehicles that include the components illustrates in FIG. 2. For example, a model train that includes a memory device incorporated into a controller (e.g., microprocessor), a controller that functions as a smoke, sound and/or motor module, and/or a motor module that does not include a PWM is within the spirit and scope of the present invention. It should also be appreciated that, for the sake of simplicity, FIG. 2 does not depict all features that are commonly found in model vehicles, and are generally known by those of ordinary skill in the art. Thus, for example, a model train that includes features that are not shown in FIG. 2 (e.g., a feedback circuit that allows the controller or motor module to sense train speed and motor features (voltage, current, PWM data, etc.)) is within the spirit and scope of the present invention.

Figure 3:
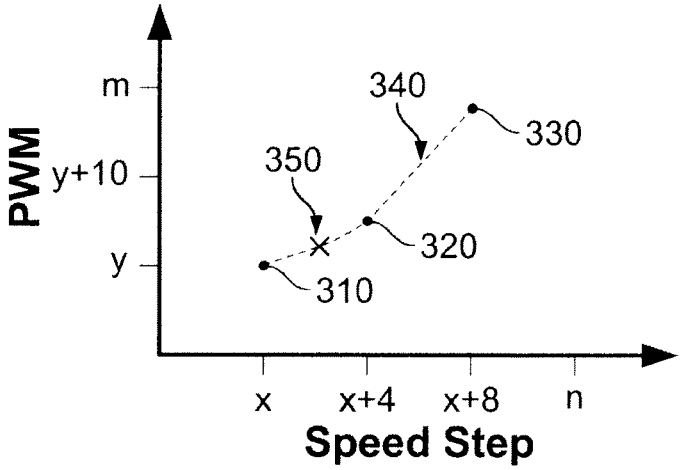
FIG. 3 illustrates a graph that charts pulse width modulation versus speed steps during test conditions.

In one embodiment of the present invention, the memory device 250 is a non-volatile memory (NVM) device that is configured to store calibration data for the model train. In a preferred embodiment, the calibration data is generated from a model train operating under test conditions, e.g., on a test track, and includes at least one relationship between at least one speed and data used to propel the model train at the speed. For example, FIG. 3 illustrates calibration data measured from a model train operating under test conditions and includes relationships between different speed steps and different PWMs. As shown in FIG. 2, a first calibration point of 310 is associated with a speed step of X and a PWM of Y, a second calibration point of 320 is associated with a speed step of X+4 and a PWM of y+10, and a third calibration point of 330 is associated with a speed step of N and a PWM of M. Other calibration points (e.g., 350) may either be measured, or extrapolated based on calibration points (e.g., 310, 320) that have been measured.

It should be appreciated that FIG. 3 is not a limitation of the present invention, but merely an example of calibration data. For purposes of the invention, calibration data can include any data that defines a relationship between at least one speed and data that can be used to propel a model train at the at least one speed. It should also be appreciated that while the calibration data is (i) collected while a first model train is operating under test conditions (e.g., on a test track assembled by the manufacturer, preferably during the manufacturing process), (ii) stored in an NVM device of a second model train, and (iii) used by a controller to control at least one feature in the second model train while it operates under normal conditions (e.g., on a track assembled by a user, etc.), the first and second model trains can either be different or one in the same. In other words, calibration data could be (i) collected from a model train operating under test conditions, (ii) stored in an NVM device in the same train, and (iii) used to control at least one feature of the same train while it operates under normal conditions. Alternately, calibration data could be (i) collected from a model train operating under test conditions, (ii) stored in an NVM in a different model train (e.g., one having similar features as the test model train, a replica of the test model train, etc.), and (iii) used to control at least one feature in the different model train while it operates under normal conditions.

Referring back to FIG. 2, if the controller 210 receives instructions from the remote control to operate the model train at a particular speed step, then the controller 210 may instruct the motor module 220 to operate the motor 260 at a particular speed (i.e., a speed corresponding to the particular speed step). This can be done, for example, by varying the PWM 222. Given that the model train may be under a given load (e.g., traveling up a hill, traveling down a hill, pulling a load, etc.), the PWM must be operated at a level sufficient to propel the model train (under the given load) at the particular speed. The resulting PWM data is then communicated to the controller 210 (e.g., via the motor module 220, the motor 260, etc.), and used to calculate a load that the model train (or motor included therein) is under.

Specifically, this is done by comparing the received PWM data to calibration data stored in the NVM 250, and determining a delta for the PWM data. For example, if the received PWM data for a speed step of X is M, and the calibration data provides that under test conditions, PWM data for a speed step of X is Y, then the PWM delta is M−Y. The delta indicates the load in which the motor is operating under, and can be used by the controller 210 to generate a corresponding sound and amount of smoke. For example, if the delta is negative, then the controller 210 knows that the load is less than that experienced under test conditions, and if it is positive, then the controller 210 knows that the load is greater than that experienced under test conditions. The controller 210 can also estimate the amount of load based on the variation (or delta) between the received PWM and the PWM included in the calibration data. In other words, the greater the delta, the heavier (or lighter if the delta is negative) the load. The controller 210 can then use this information to control the smoke module 230 (e.g., to produce a particular amount of smoke, to vary the interval of smoke, etc.) and the sound module 230 (e.g., to produce a particular sound (e.g., chuffing, etc.), to vary the volume of sound, etc.).

It should be appreciated that control of the smoke and/or sound modules may be based (at least in part) on instructions provided via the remote control and/or operation of the controller. For example, the controller may be configured to instruct the smoke module to generate smoke in response to receiving a related instruction from the remote control. Alternately, the controller may be configured to instruct the smoke module to generate smoke only after a related instruction has been received from the remote control and load data has been received and compared to calibration data. The latter allows the controller to not only activate the smoke feature, but control it so that the smoke produced is related to a load on the model train. One of ordinary skill in the art will understand that the software stored in the controller (or a memory device attached thereto) will dictate how the controller functions, and how sound and smoke features are ultimately controlled.

Figure 4:
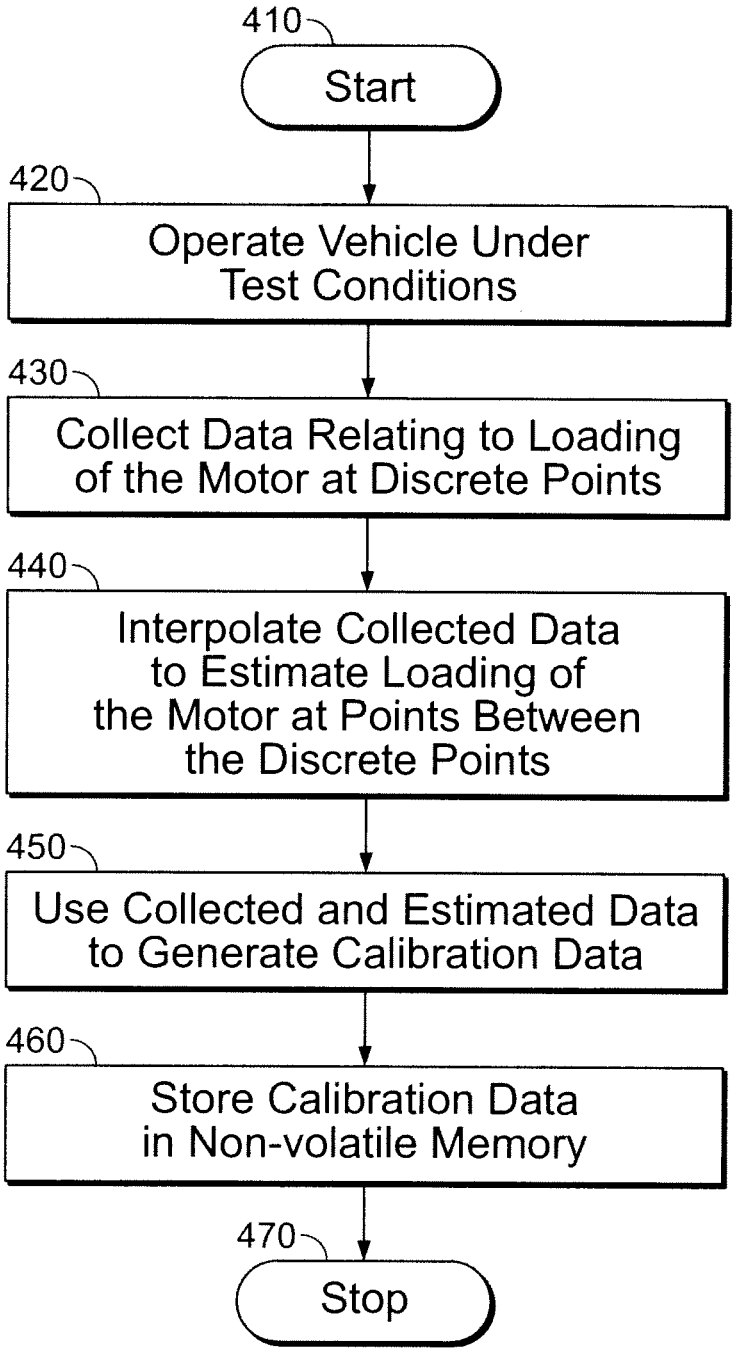
FIG. 4 provides a method for collecting and recording calibration data in accordance in one embodiment of the present invention.

FIG. 4 provides a method of collecting and recording calibration data in accordance with one embodiment of the present invention. Specifically, starting at step 410, a model vehicle is operated under test conditions (e.g., on a test track, etc.) at step 420. Components similar to the ones shown in FIG. 2 are used at step 430 to collect data relating to loading of a motor in the model vehicle. For example, as shown in FIG. 3, PWM data may be collected at different speed steps. To the extent that discrete speeds steps are used, PWM data for other speed steps can then be estimated or extrapolated from the collected data at step 440. The resulting collected/estimated data can then be compiled and stored at steps 450 and 460, ending the process at step 470. It should be appreciated that the present invention is not limited to the steps set forth in FIG. 4, and that the steps do not need to be performed in the order presented. For example, any estimation or interpolation can be performed at the time of testing or while the model vehicle is being operated under normal conditions.

Figure 5:
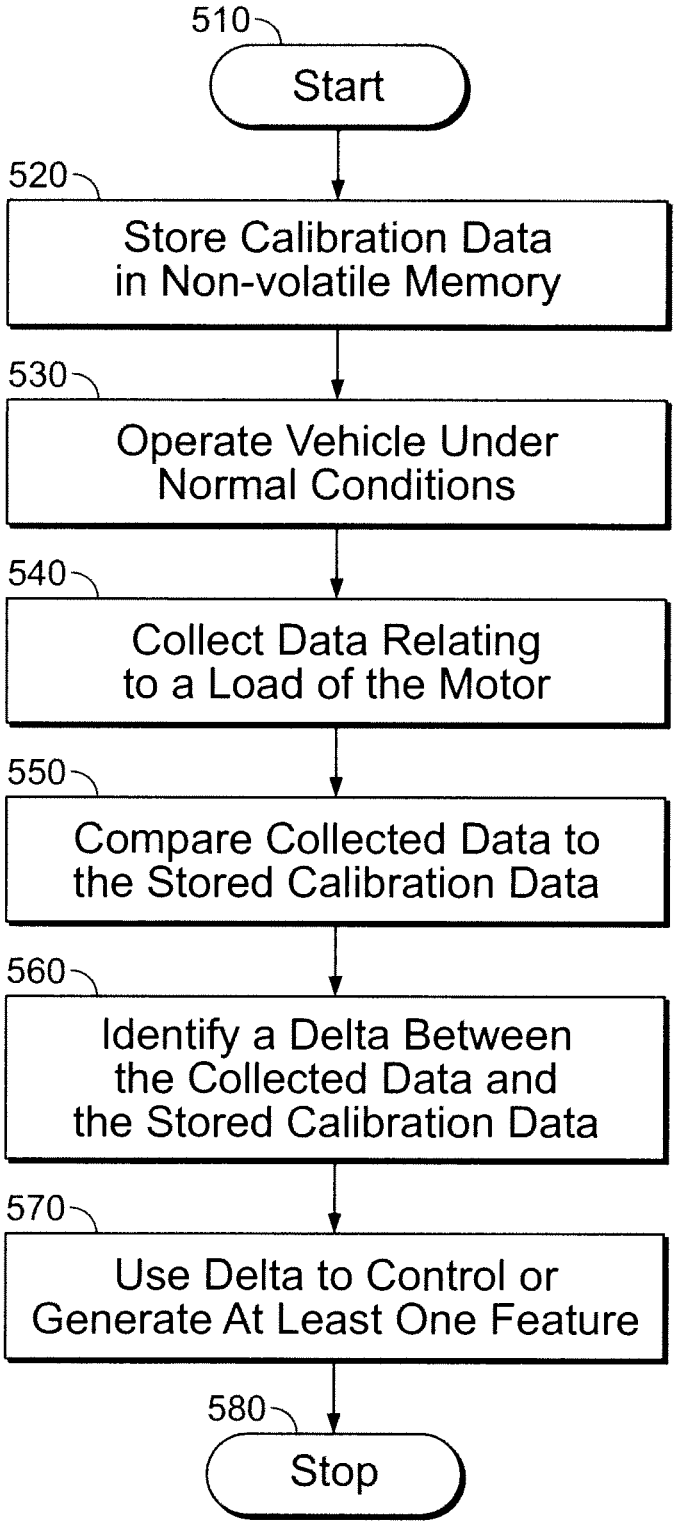
FIG. 5 provides a method for using previously stored calibration data to generate at least one feature in a model vehicle in accordance with another embodiment of the present invention.

FIG. 5 provides a method for using previously stored calibration data to generate at least one feature in a model vehicle in accordance with another embodiment of the present invention. Specifically, starting at step 510, calibration data is stored in a memory device in the model vehicle at step 520. The model vehicle is then operated under normal conditions at step 530. While the model vehicle is being operated, data relating to a load of a motor in the model vehicle is collected at step 540. This data may include, for example, PWM data, voltage data or current data. The collected data is then compared to the calibration data stored in the memory device at step 550. A delta between the collected data and the stored data is then identified at step 560. For example, as shown in FIG. 3, and discussed above, collected PWM data for a speed step can be compared to stored PWM data for that speed step in order to identify a delta PWM. The delta can then be used at step 570 to control at least one feature (e.g., sound, smoke, etc.), ending the process at step 580. It should be appreciated that the present invention is not limited to the steps set forth in FIG. 5. For example, while the identified delta may be used to control sound and smoke in the model train, it also (or alternatively) may be used to control other features, including visual features (e.g., lights, etc.), tactile features (e.g., vibration in the remote control, etc.), and mechanical features.

Having thus described several embodiments of a system and method for using load related data to generate a corresponding sound and amount of smoke, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A model vehicle, comprising:

a motor for propelling said model vehicle in at least a forward direction;

a memory for storing calibration data comprising a plurality of pre-determined power levels, said calibration data linking at least one speed step representing a target speed to a pre-determined power level for propelling a first model vehicle at said target speed;

at least one motor module for controlling operation of said motor;

at least one feature module for controlling at least one feature of said model vehicle, said at least one feature being selected from at least one visual action, at least one audible action, and at least one tactile action; and a controller in communication with said memory, said at least one feature module, and at least one of said motor module and said motor, said controller being configured to:

receive first data from one of said motor module and a remote control on said speed step of said model vehicle, said speed step representing said target speed of said model vehicle;

receive second data from one of said motor module and said motor at a time when a speed of said model vehicle equals said target speed, said second data is an actual power level for propelling said model vehicle at said target speed;

using said target speed to identify said pre-determined power level from said plurality of pre-determined power levels in said memory;

identifying a delta between said actual power level and said pre-determined power level at said time when said speed of said model vehicle equals said target speed, wherein said delta is a difference between said actual power level needed to propel said model vehicle at said target speed and said pre-determined power level needed to propel said first model vehicle at said target speed;

using said delta to instruct said at least one feature module to correspondingly control said at least one feature of said model vehicle.

2. The system of claim 1, wherein said pre-determined power level used for propelling a first model vehicle at said target speed comprises pulse width modulation (PWM) data.

3. The system of claim 1, wherein said pre-determined power level used for propelling a first model vehicle at said target speed comprises a voltage.

4. The system of claim 1, wherein said pre-determined power level used for propelling a first model vehicle at said target speed comprises a current.

5. The system of claim 1, wherein said first model vehicle is said model vehicle.

6. The system of claim 1, wherein said calibration data is based on a plurality of speed steps, wherein each speed step corresponds to a particular pulse width modulation (PWM).

7. The system of claim 1, wherein said at least one feature module is a sound module for generating at least one sound, and said controller is configured to instruct said sound module to generate a sound corresponding to said delta.

8. The system of claim 1, wherein said at least one feature module is a smoke module for generating smoke, and said controller is configured to instruct said smoke module to generate at least one of an amount of smoke and a duration of smoke corresponding to said delta.

9. The system of claim 1, wherein said second data is pulse width modulation (PWM) data, and said controller is further configured to use said first data on said speed step and said PWM data to identify a delta between said PWM data and said calibration data at said speed step.

10. A method for controlling a feature in a model vehicle based on load of a motor, comprising:

storing calibration data in a non-volatile memory (NVM), said calibration data comprising a plurality of pre-determined power levels and linking at least one speed step representing a target speed to a pre-determined power level for propelling a first model vehicle at said target speed;

receiving by a controller a first set of data on a speed step of said model vehicle, said speed step corresponding to a target speed of said model vehicle;

receiving by said controller a second set of data at a time when a speed of said model vehicle equals said target speed, said second set of data is an actual power used to propel said model vehicle at said target speed;

receiving by said controller said calibration data from said NVM;

using by said controller said target speed to identify said pre-determined power level from said plurality of pre-determined power levels in said NVM;

identifying a delta between said actual power level and said pre-determined power level at said time when said speed of said model vehicle equals said target speed, wherein said delta is a difference between said actual power level needed to propel model vehicle at said target speed and said pre-determined power level needed to propel said first model vehicle at said target speed; and using said delta to control at least one feature of said model vehicle, said at least one feature being selected from at least one visual feature, at least one audible feature, and at least one tactile feature.

11. The method of claim 10, wherein said step of storing calibration data in said NVM, further comprises storing calibration data that includes at least one relationship between said speed step representing said target speed and pulse width modulation (PWM) data used for controlling a motor in said first model vehicle.

12. The method of claim 10, wherein said step of storing calibration data in said NVM, further comprises storing calibration data that includes at least one relationship between said speed step representing said target speed and at least one of voltage provided to a motor of said first model vehicle a current that passes through said motor.

13. The method of claim 10, wherein said step of storing calibration data in said NVM further comprises storing calibration data that includes at least one relationship between a speed step representing said target speed and a pre-determined power level to propel said model vehicle.

14. The method of claim 10, wherein said step of storing calibration data in said NVM, further comprises storing calibration data that is based on a plurality of speed steps, wherein each speed step corresponds to a particular pulse width modulation (PWM).

15. The method of claim 10, wherein said step of using said delta to control at least one feature of said model vehicle further comprises using said delta to generate a corresponding sound.

16. The method of claim 10, wherein said step of using said delta to control at least one feature of said model vehicle further comprises using said delta to generate at least one of a corresponding amount of smoke and a corresponding duration of smoke.

17. The method of claim 10, wherein said step of using said delta to control at least one feature of said model vehicle further comprises using said delta to both generate a corresponding sound and generate at least one of a corresponding amount of smoke and a corresponding duration of smoke.

18. The method of claim 10, wherein said step of using said first data and said second data to identify a delta between said second data and said calibration data at said speed step, further comprises identifying a delta between pulse width modulation (PWM) data used to propel said model vehicle at said target speed and PWM data included in said calibration data at said speed step.

19. A method for controlling a feature in a second model vehicle, comprising:

operating a first model vehicle under test conditions;

collecting calibration data from said first model vehicle, wherein said calibration data includes power data used to propel said first model vehicle at different speeds corresponding to different speed steps;

storing said calibration data in a non-volatile memory (NVM) in said second model vehicle;

receiving by a controller in said second model vehicle data on a current speed step of said second model vehicle;

receiving by said controller in said second model vehicle power data at a time when said second model vehicle reaches a speed associated with said current speed step;

using said current speed step to identify a corresponding portion of said power data included in said calibration data;

identifying by said controller at said time when said second model vehicle reaches said speed associated with said current speed step a delta between said power data used by said second model vehicle to reach said speed associated with said current speed step and said portion of said power data included in said calibration data that corresponds to said current speed step; and using said delta, which is a power differential, to at least one of generate and control at least one feature of said model vehicle, said at least one feature being selected from a sound feature and a smoke feature.

20. The method of claim 19, wherein said first model vehicle and said second model vehicle are different vehicles.

* * * * *